US007013688B2

(12) United States Patent
Chen

(10) Patent No.: US 7,013,688 B2
(45) Date of Patent: Mar. 21, 2006

(54) TOP-AND-BOTTOM LATCH LOCK

(76) Inventor: Lynn Chen, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/406,193

(22) Filed: Apr. 4, 2003

(65) Prior Publication Data

US 2004/0194519 A1 Oct. 7, 2004

(51) Int. Cl.
*E05B 59/00* (2006.01)

(52) U.S. Cl. ..... 70/107; 70/109; 292/34

(58) Field of Classification Search ..... 70/107–110, 70/95, 99, 100; 292/34, 35, 37
See application file for complete search history.

(56) References Cited

U.S. PATENT DOCUMENTS 1,596,992 A * 8/1926 Ognowicz ..... 70/109
1,646,674 A * 10/1927 Angelillo ..... 70/109
3,953,061 A * 4/1976 Hansen et al. ..... 292/5
5,265,920 A * 11/1993 Kaup et al. ..... 292/40
5,498,038 A * 3/1996 Simon et al. ..... 292/36
5,782,114 A * 7/1998 Zeus et al. ..... 70/109
5,901,989 A * 5/1999 Becken et al. ..... 292/35
6,007,114 A * 12/1999 Hotzl ..... 292/34

* cited by examiner

*Primary Examiner*—Suzanne Dino Barrett

(57) ABSTRACT

A top-and-bottom latch lock includes symmetrical L-shaped control rods provided with pressing portions for connecting to springs. The ends of the control rods are configured with braking pieces provided with bumps, and symmetrical gulfs are defined in a flat member to accommodate the bumps of the braking pieces. A turning axis having an opening is disposed above the flat member, and an oscillating shaft is disposed below the flat member. Accordingly, the control rods are extended outward or contracted inward through turning of a rotation body, a key or handles of the lock, thereby locking or opening a door.

1 Claim, 9 Drawing Sheets

TOP-AND-BOTTOM LATCH LOCK

BACKGROUND OF THE INVENTION (a) Field of the Invention

The present invention relates to a top-and-bottom latch lock, and more particularly to a top-and-bottom latch lock having simple assembly and smooth operation.

(b) Description of the Prior Art

During recent years, owing to changes in architectural structures, directions for opening doors have transformed from in-and-out to left-and-right in order to decrease additional areas needed when opening the doors. Therefore, conventional locks have consequently become unsuitable for sliding doors, and top-and-bottom latch locks locked by a vertically moving up and down mechanism are required. However, common top-and-bottom latch locks have cumbersome designs requiring that the latches be pushed vertically up and down, and hence operating the top-and-down latch lock cannot be regarded as providing smooth operation of such.

SUMMARY OF THE INVENTION

Therefore, a primary objective of the invention is to provide a top-and-bottom latch lock having a simple assembly as well as providing for a more smooth and effort-saving operation.

A The top-and-bottom latch lock is structured to comprise symmetrical L-shaped control rods, pressing portions configured on the controls rods for connecting to springs, a braking piece configured at one end of each of the control rods respectively, the braking pieces being provided with bumps, and a flat member having symmetrical gulfs for accommodating the bumps of the braking pieces, such that when a rotation body is turned, the control rods of the lock structure extend outward or contract inward in coordination with tension of the springs, thereby locking or opening a door.

The aforesaid lock structure further comprises a turning axis disposed above the flat member, wherein the turning axis is connected with a keyhole, and upon a key being inserted into the keyhole and rotated, thereat drives the turning axis in forward and reverse directions for further impelling a rotation body, thereby locking or opening the lock using a key.

The aforesaid lock structure further comprises an oscillating shaft provided below the flat member and which is pressed against by a Y-shaped axis. The Y-shaped axis is pivotally connected to handles of the lock structure, such that the control rods are displaced in upward and downward directions through impelling of the oscillating shaft, thereby opening or locking the lock.

DETAILED DESCRIPTION OF THE PREFERRED EMBODIMENTS

To better understand the characteristics and novelties of the invention, descriptions shall be given with the accompanying drawings hereunder.

Figure 1:
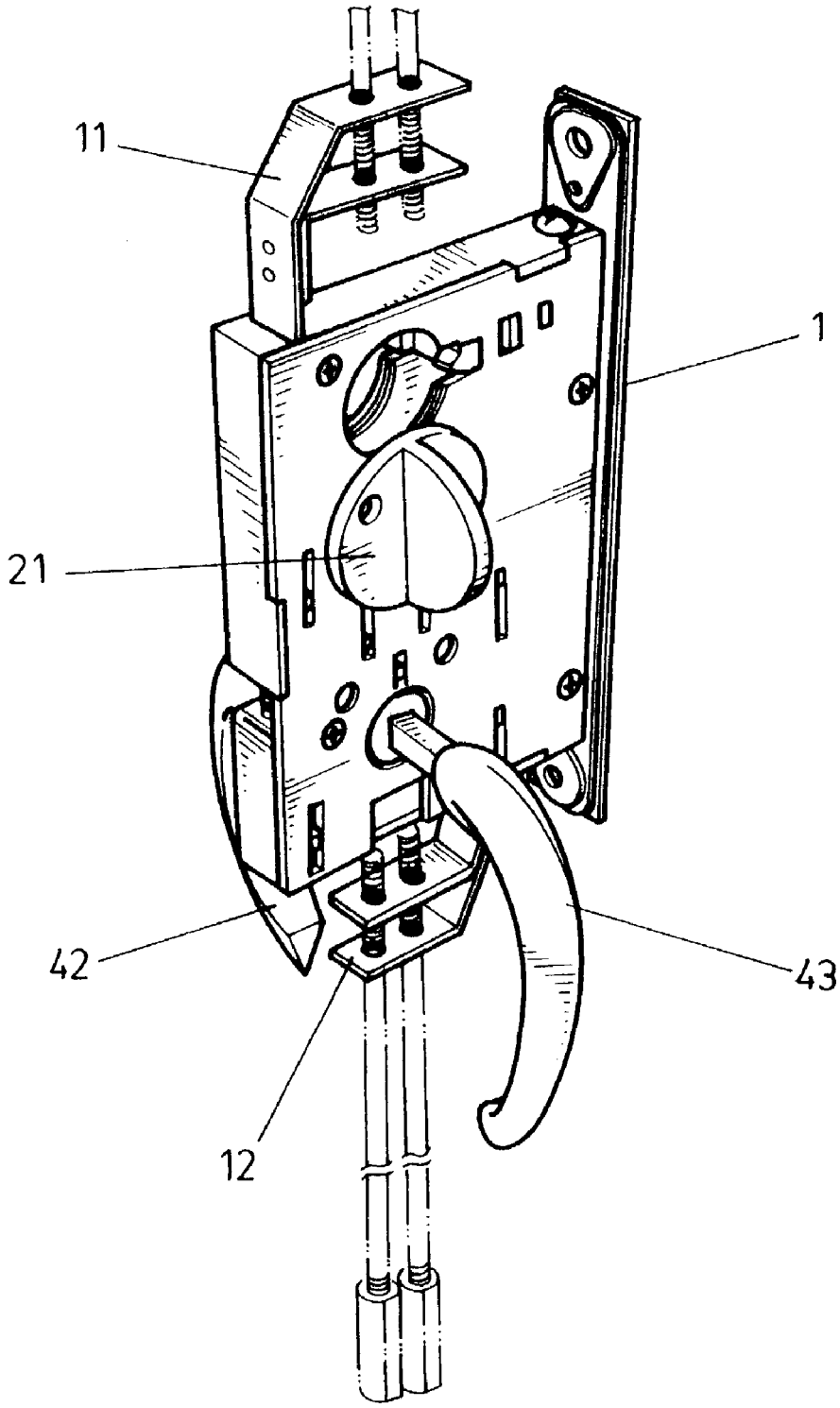
FIG. 1 shows an elevational schematic view according to the present invention.
Figure 2:
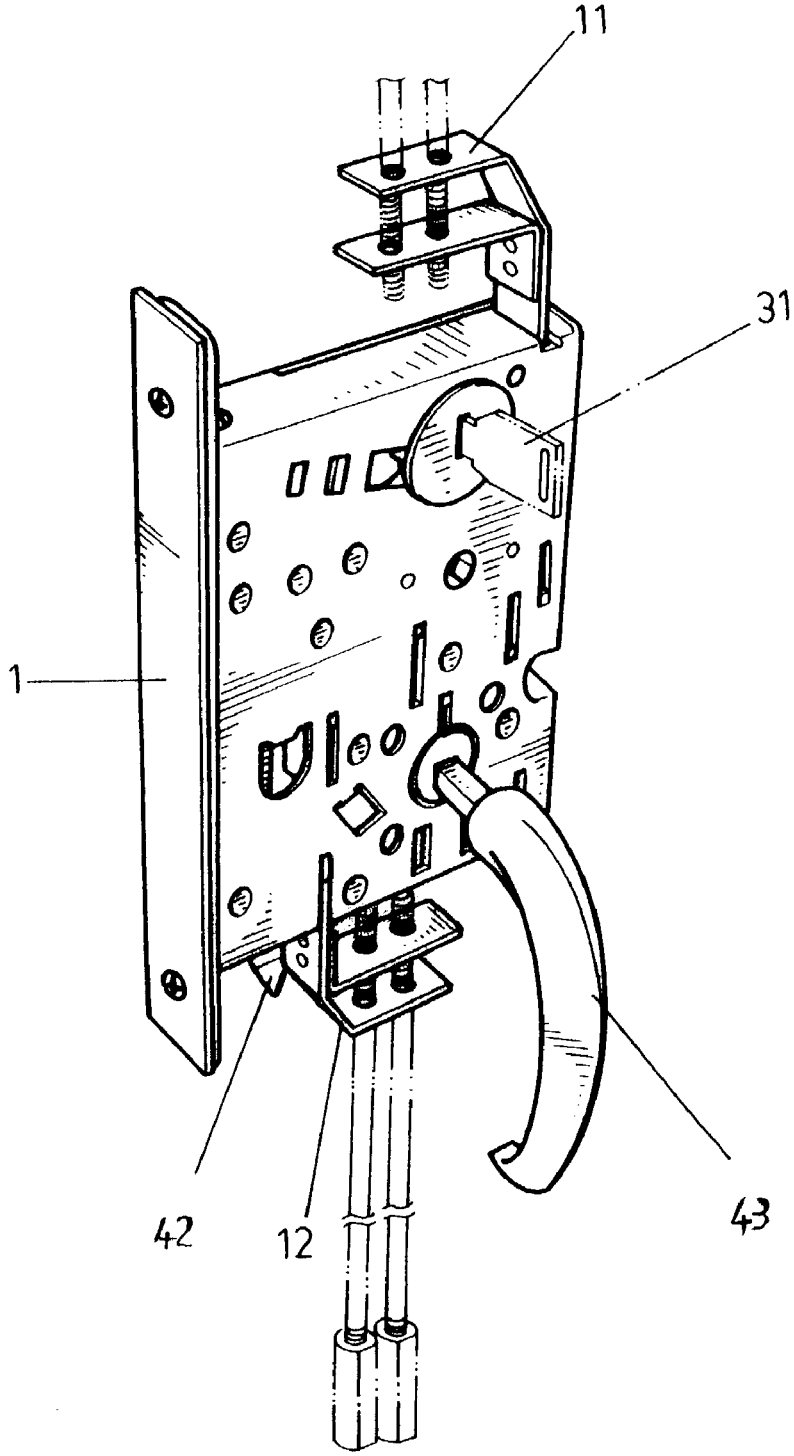
FIG. 2 shows another elevational schematic view according to the present invention.
Figure 3:
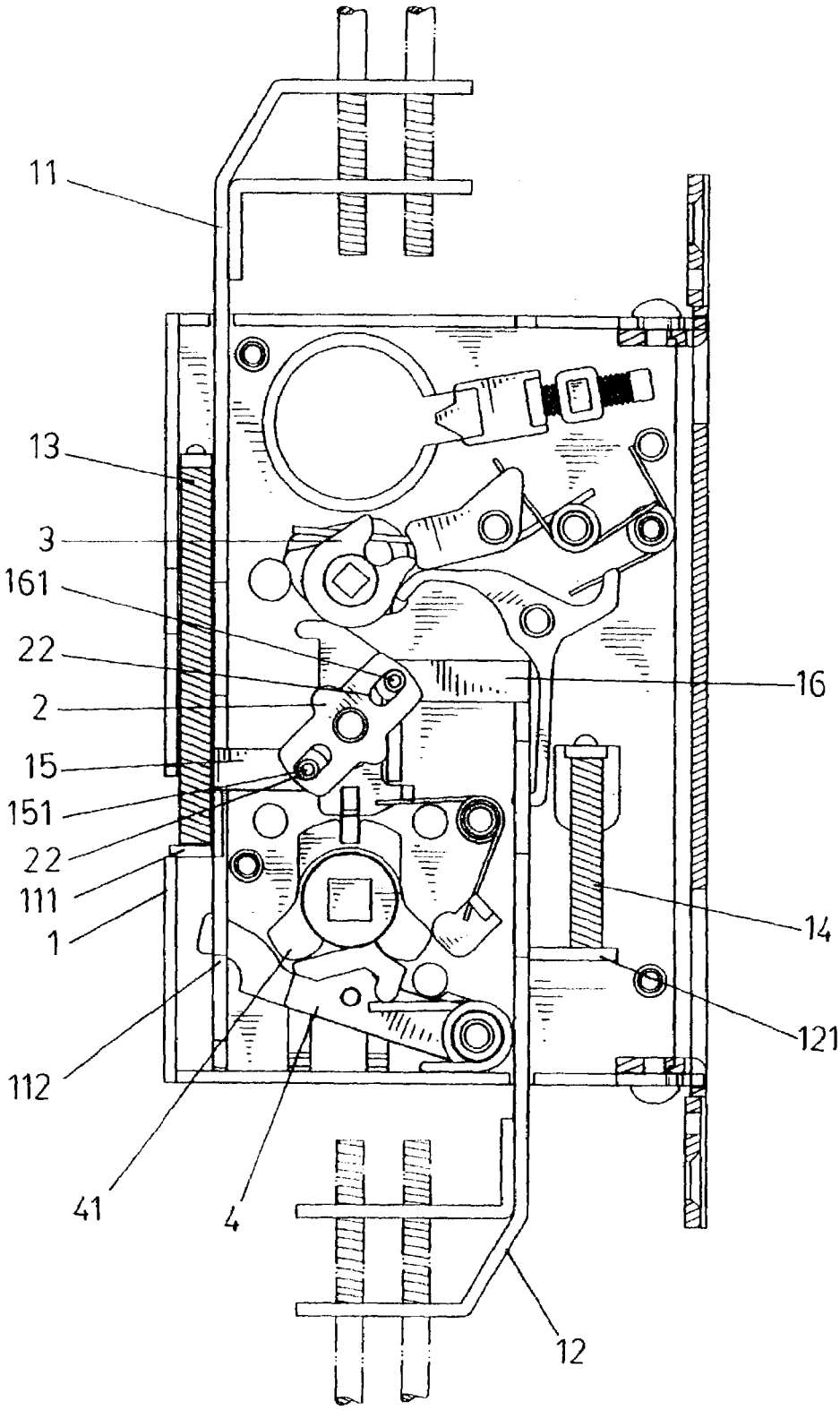
FIG. 3 shows a structural schematic view according to the present invention.

Referring to FIGS. 1, 2 and 3, which show elevational and structural schematic views according to the present invention, wherein the present invention comprises:

a main body 1 configured with symmetrical L-shaped control rods 11 and 12, pressing portions 111 and 121 configured on the control rods 11 and 12, and which are utilized for connecting to springs 13 and 14 respectively, an indenture 112 provided at the control rod 11, braking pieces 15 and 16 configured at one end of each of the control rods 11 and 12, respectively, and bumps 151 and 161 provided on the braking pieces 15 and 16;

a semi-circular flat member 2 for pivotally connecting to a rotation body 21 at an exterior of the main body 1 and which are provided with gulfs 22 in two bottom sides respectively thereof; wherein the two gulfs 22 are for accommodating the bumps 151 and 161 provided on the braking pieces 15 and 16 of the control rods 11 and 12, such that the control rods 11 and 12 extend upward or downward or contract inward from the lock structure 1 when the bumps 151 and 161 are impelled by turning the rotation body 21, thereby locking or opening a door;

an open turning axis 3 disposed above the flat member 2 and connected with a keyhole of the main body 1, so as to displace the control rods 11 and 12 in upward and downward directions due to pushing or pulling forces imposed upon the flat member 2 by the turning axis 3 when a key 31 is turned in a keyhole thereof; and an oscillating shaft 4 disposed below the flat member 2, and which is pressed against by a Y-shaped axis 41 pivotally connected to inner and outer handles 42 and 43 of the main body 1; wherein a front end of the oscillating shaft 4 is inserted and fastened to the indenture 112 of the control rod 11, so that the flat member 2 is relatively impelled by a pulling force imposed upon the control rod 11 by the oscillating shaft 4 when the handle 42 or 43 is turned, thereby contracting the control rods 11 and 12 for opening or extending upward or downward for locking.

Figure 4:
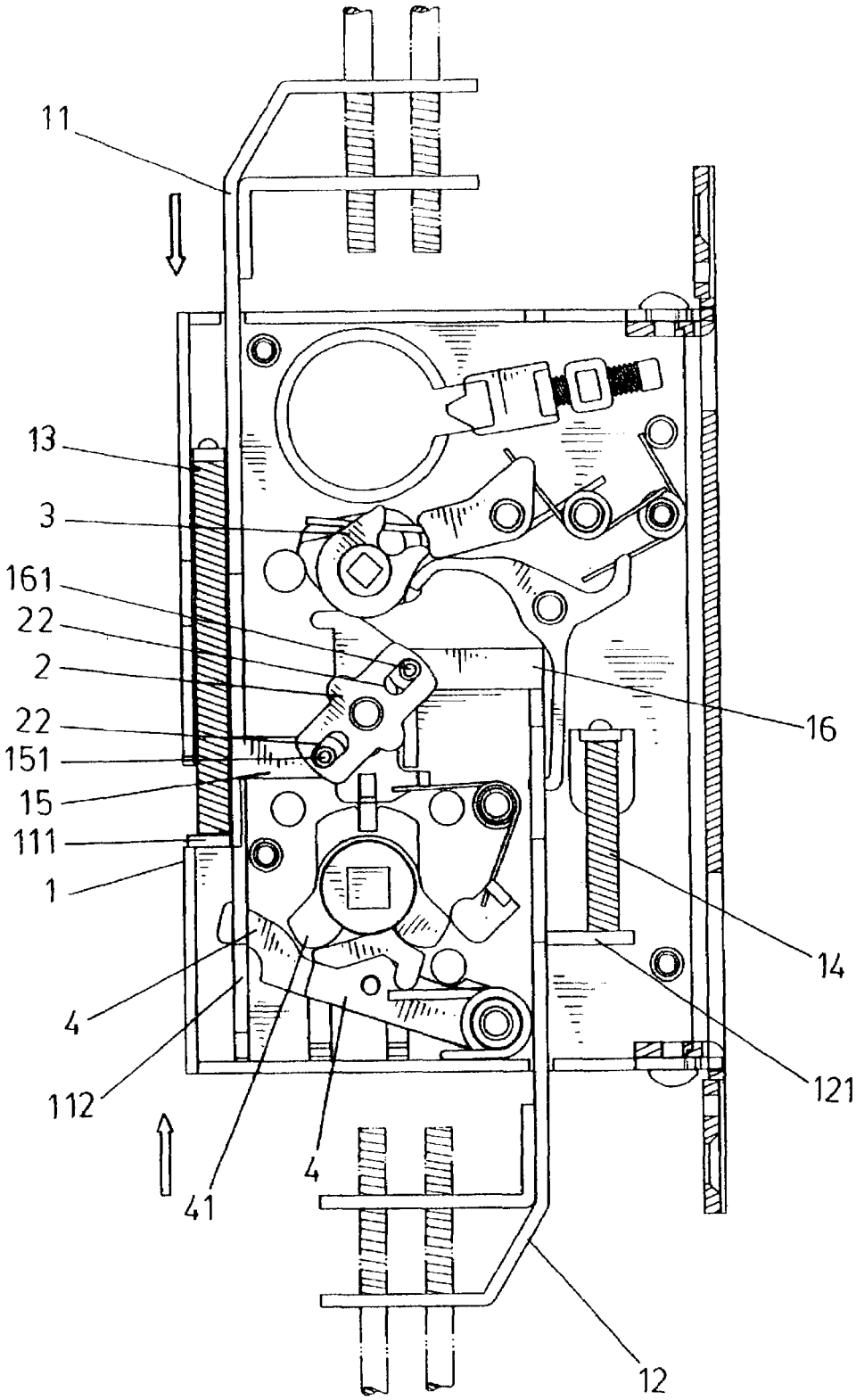
FIG. 4 shows a schematic view for illustrating movements of a rotation body in an embodiment according to the present invention.
Figure 5:
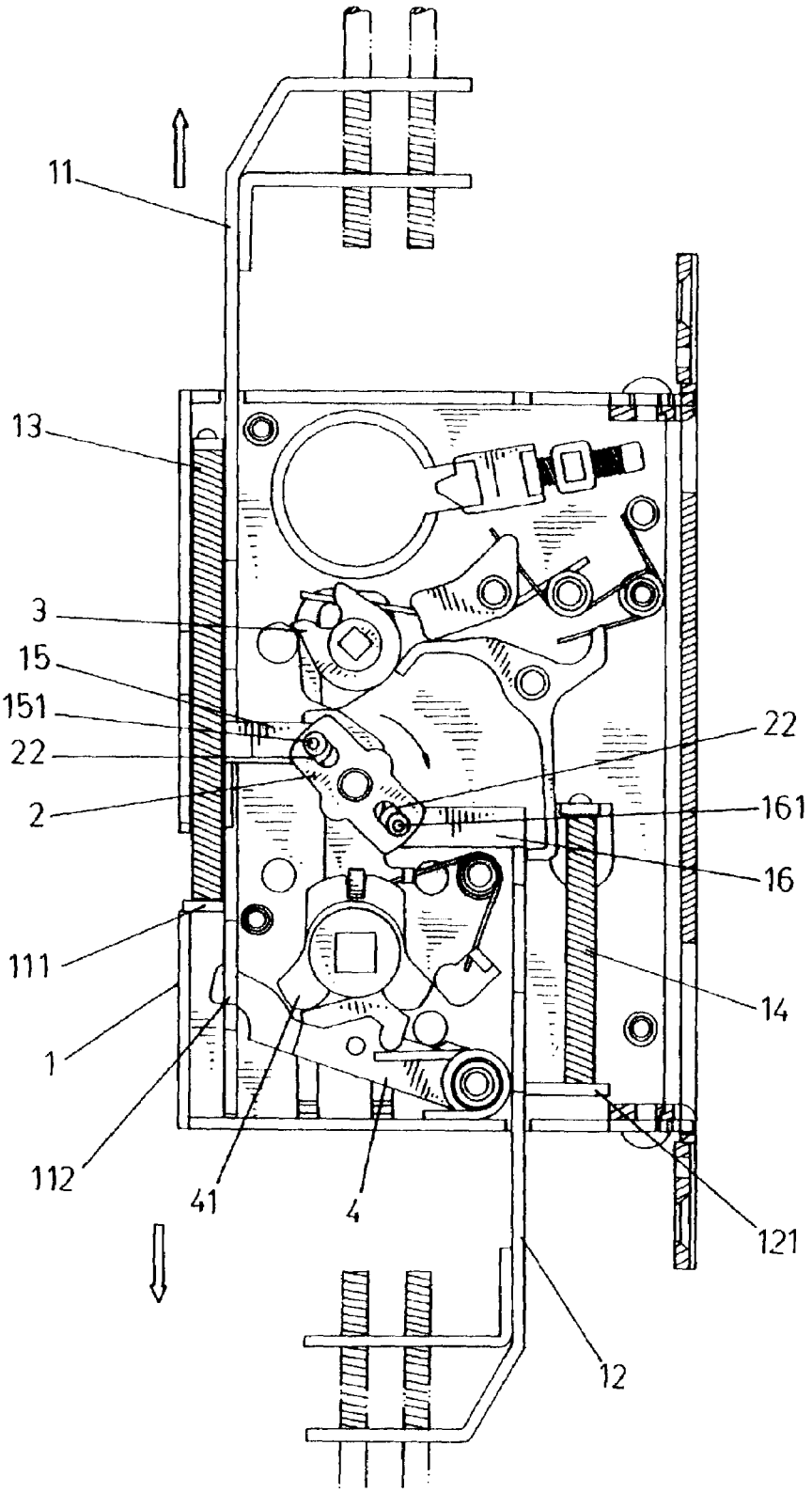
FIG. 5 shows another schematic view for illustrating movements of the rotation body in an embodiment according to the present invention.

Referring to FIGS. 4 and 5, which show schematic views for illustrating movements of the rotation body 21 in an embodiment according to the present invention, wherein when the rotation body 21 is turned, the flat member 2 is impelled such that the gulfs 22 also impel the bumps 151 and 161 on the control rods 11 and 12, thereby displacing the control rods 11 and 12 in upward and downward directions for locking or opening of the lock structure.

Figure 6:
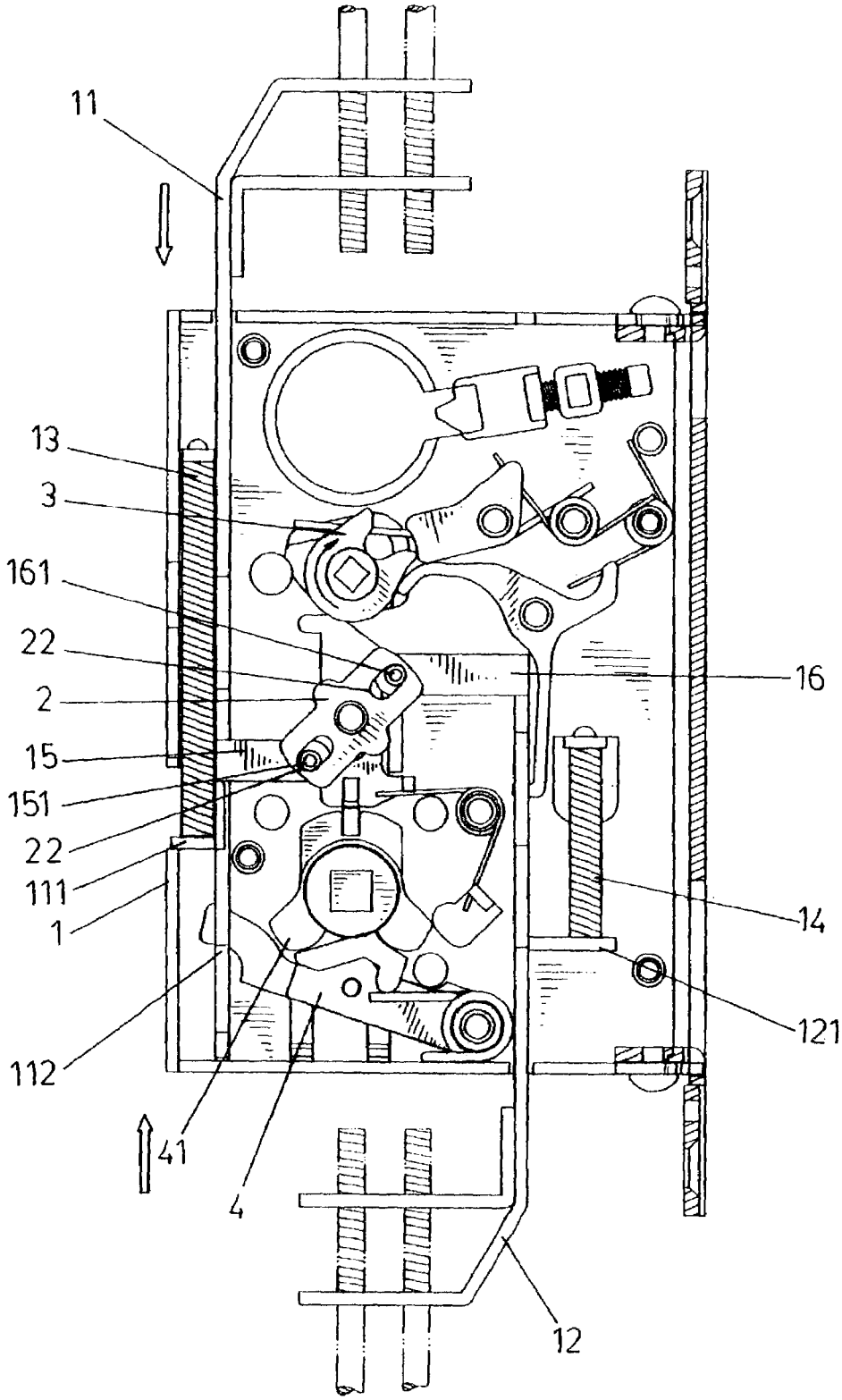
FIG. 6 shows a schematic view for illustrating locking and opening using a key in an embodiment according to the present invention.
Figure 7:
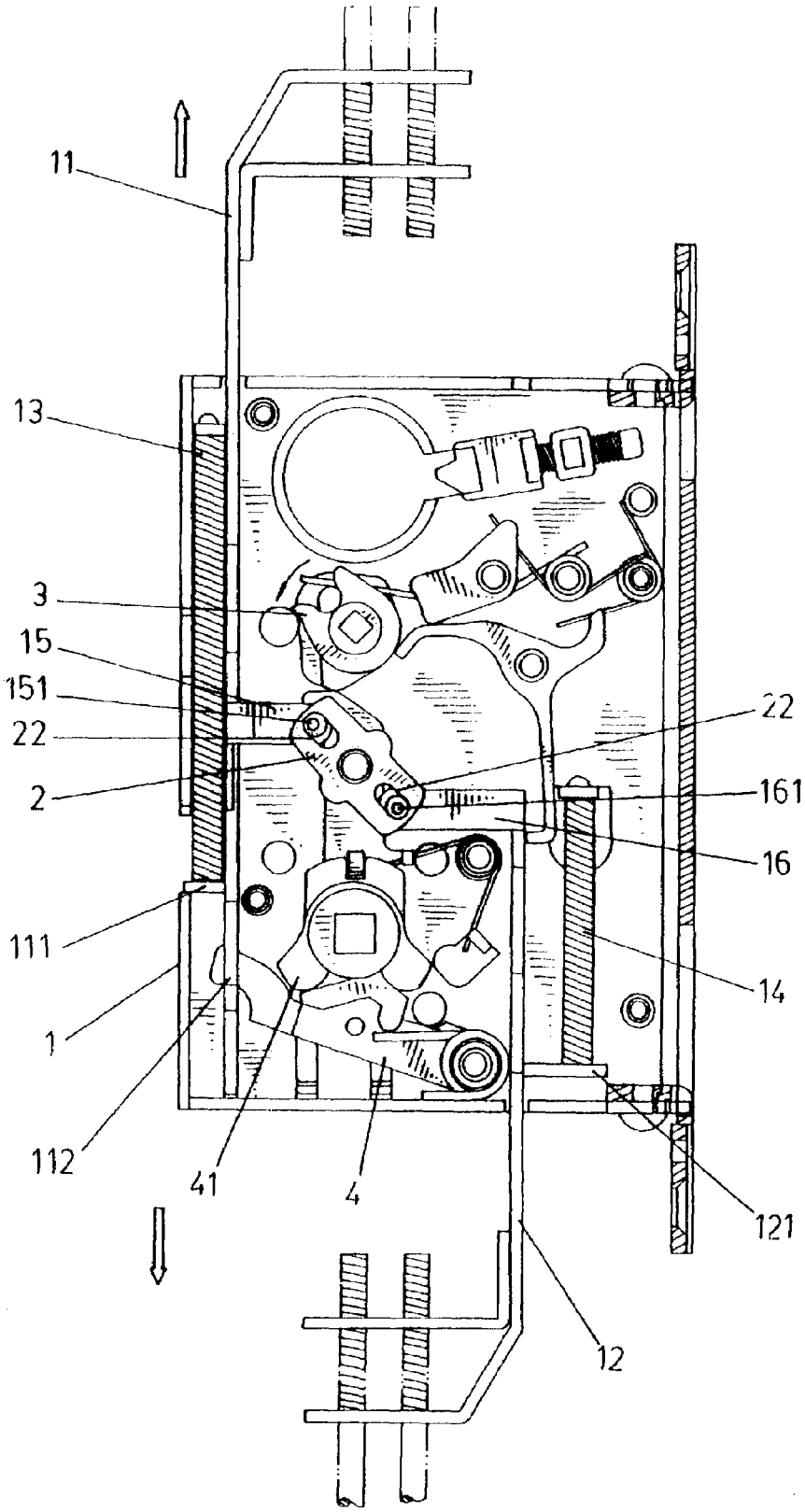
FIG. 7 shows another schematic view for illustrating locking and opening using the key in the embodiment according to the present invention.

Referring to FIGS. 6 and 7, which show schematic views for illustrating locking and opening using a key in the embodiment according to the present invention, wherein the turning axis 3 is turned when using the key 31 for opening, so that pushing or pulling forces are imposed upon the flat member 2, thereby extending or contracting the control rods 11 and 12 in upward and downward directions by impelling of the flat member 2 for opening and locking of the lock structure.

Figure 8:
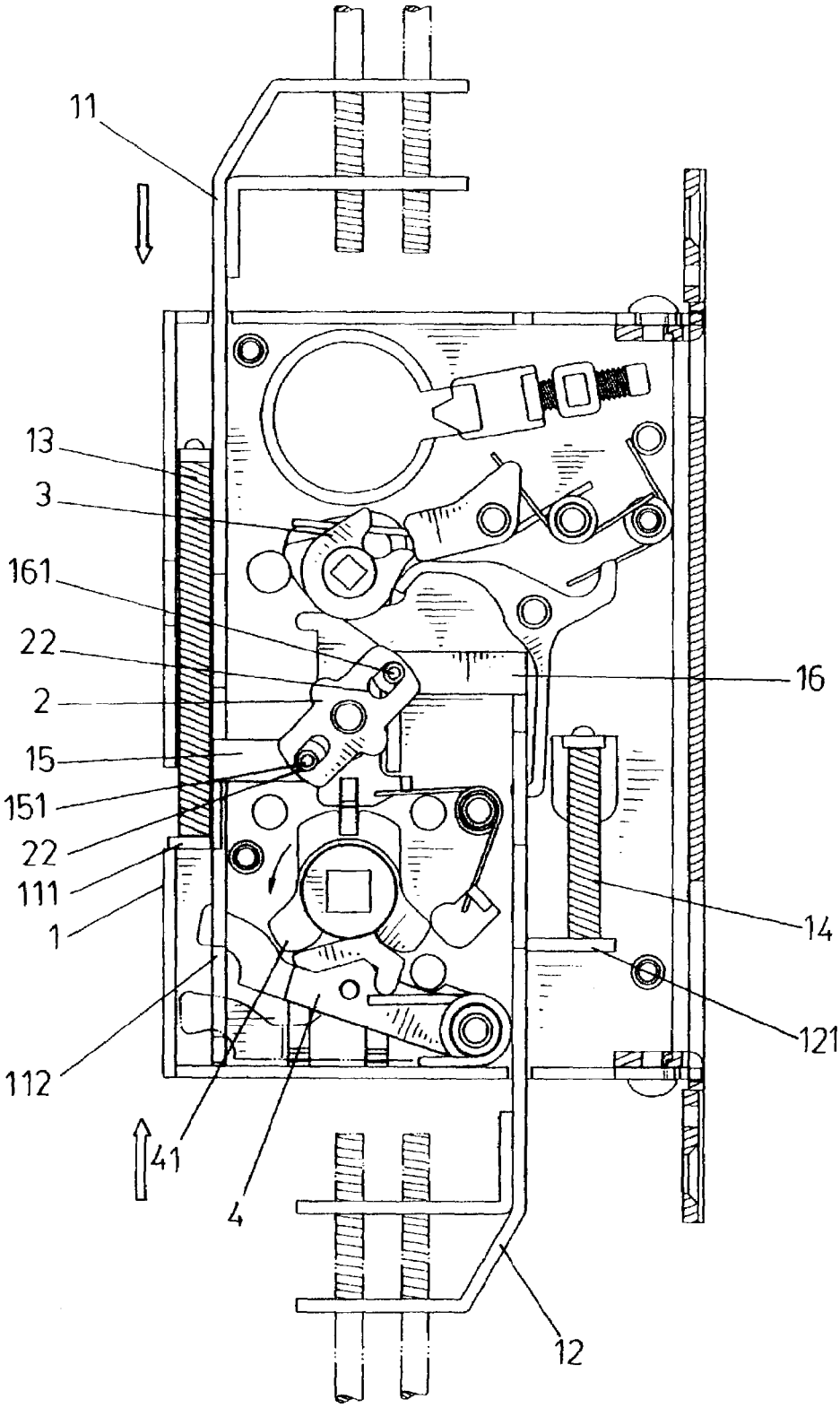
FIG. 8 shows a schematic view for illustrating a handle being used for opening or locking in the embodiment according to the present invention.
Figure 9:
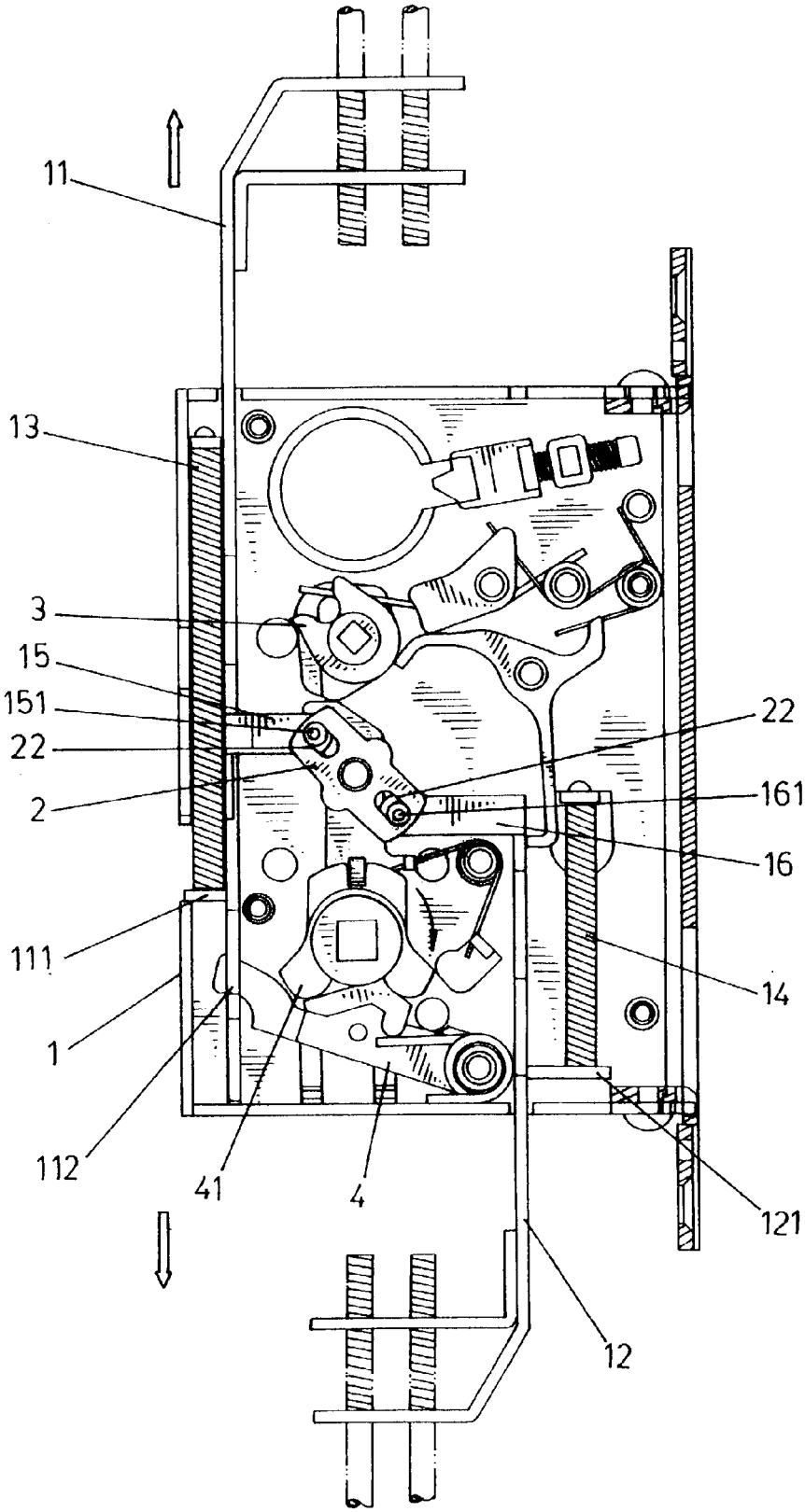
FIG. 9 shows a schematic view for illustrating a handle being used for opening or locking in another embodiment according to the present invention.

Referring to FIGS. 8 and 9, which show schematic views for illustrating a handle being used for opening and locking in the embodiment according to the present invention, wherein the Y-shaped axis 41 is rotated when turning the inner or outer handles 42 and 43, and thus pressing against or slackening the oscillating shaft 4. When pressing against the oscillating shaft 4, the control rod 11 is impelled and extended downward by the oscillating shaft 4, and relatively impelling the control shaft 12 through the flat member 2, thereby forming movements for locking. Vice versa, when slackening the oscillating shaft 4, the control rods 11 and 12 are contracted through a reverse rotation of the flat member 2, thereby accomplishing movements for opening.

Conclusive from the above, the flat member having the gulfs 22 according to the present invention, in coordination with the control rods 11 and 12 provided with the springs 13 and 14, enable the top-and-bottom latch lock to have easy assembly capable of smooth operation. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A top-and-bottom latch lock comprising:

two L-shaped control rods configured with pressing portions at an appropriate location, the pressing portions being respectively connected to springs, and a braking piece having a bump configured at one end of each of the control rods respectively, wherein one of the control rods is provided with an indenture;

a flat member for pivotally connecting to a rotation body at an exterior of a main body, wherein, the flat member is defined with gulfs in two bottom sides of the flat member, respectively, the gulfs being utilized to accommodate the bumps configured on the braking pieces connected to the control rods;

a turning axis having an opening and disposed above the flat member, wherein, the turning axis is connected with a keyhole of the main body;

an oscillating shaft disposed below the flat member, and which is pressed against by a Y-shaped axis pivotally connected to inner and outer handles of the main body, wherein, a front end of the oscillating shaft is inserted and fastened to the indenture of the control rod; and the flat member is turned to different directions when turning the rotation body, handles or keyhole, thereby impelling the control rods to extend or contract in upward and downward directions, and whereupon closing or opening of the top-and-bottom latch lock is realized.

* * * * *